US006296130B1

(12) United States Patent
Forsyth et al.

(10) Patent No.: US 6,296,130 B1
(45) Date of Patent: Oct. 2, 2001

(54) ANTI BACK OFF SCREW ON CLOSURE

(75) Inventors: Michael J. Forsyth, Stow; Charles A. Webster, Bowling Green, both of OH (US); Douglas S. Martin, New Castle, PA (US); James P. Black, Twinsburg, OH (US); Bradford R. Seaman, Birdsboro, PA (US)

(73) Assignee: Weatherchem Corporation, Twinsburg, OH (US)

( * ) Notice: Subject to any disclaimer, the term of this patent is extended or adjusted under 35 U.S.C. 154(b) by 0 days.

(21) Appl. No.: 09/717,329

(22) Filed: Nov. 20, 2000

Related U.S. Application Data

(63) Continuation of application No. 09/314,372, filed on May 19, 1999, now abandoned.

(51) Int. Cl.[7] ..... B65D 50/04
(52) U.S. Cl. ..... 215/219; 215/330
(58) Field of Search ..... 215/216–219, 215/221, 330

(56) References Cited

U.S. PATENT DOCUMENTS 3,399,796 * 9/1968 Steiner .
3,612,323 * 10/1971 Malick .
3,698,584 * 10/1972 Miller .
3,722,727 * 3/1973 Gach .
3,805,987 * 4/1974 Horvath .
3,826,395 * 7/1974 Montgomery .
3,831,797 * 8/1974 Stevens, Jr. .
3,841,514 * 10/1974 Montgomery et al. .
3,891,110 * 6/1975 Gach .
3,895,730 * 7/1975 Koehne et al. .
4,172,533 * 10/1979 Montgomery .
4,326,649 * 4/1982 Marino et al. .
4,401,225 * 8/1983 Schwaikert .
4,413,742 * 11/1983 Sandhaus .
4,479,585 * 10/1984 Sandhaus .
4,500,006 * 2/1985 Lafortune et al. .
4,687,112 * 8/1987 Swartzbaugh .
4,752,013 * 6/1988 Miller et al. .
4,752,014 * 6/1988 House et al. .
5,213,223 * 5/1993 Minnette .
5,238,130 * 8/1993 Marques et al. .
5,449,077 * 9/1995 Seidler .
5,603,421 * 2/1997 Opresco .
5,671,853 * 9/1997 Herr .
5,722,546 * 3/1998 Biere .
5,803,287 * 9/1998 Kusz .
5,908,125 * 6/1999 Opresco .
5,915,576 * 6/1999 Robinson .
6,039,196 * 3/2000 Ekkert et al. .
6,047,840 * 4/2000 Moore et al. .

FOREIGN PATENT DOCUMENTS

369166 * 5/1990 (EP) .
2108095 * 5/1983 (GB) .

* cited by examiner

*Primary Examiner*—Nathan J. Newhouse
(74) *Attorney, Agent, or Firm*—Pearne & Gordon LLP

(57) ABSTRACT

Screw on caps for bottles that have an anti back off feature formed on a hinged tab of the cap engaging detent teeth below the threads on the bottle. The hinge has a unique configuration that enables the tab to snap into and hold a gripping position while avoiding temporary distortion or creep. The detent teeth are particularly suited for use with blow molded bottles and are capable of restraining a cap within a small angle of a fully tightened position to avoid any significant back off and potential leakage. In one embodiment, the anti back off feature is provided in a child resistant cap while in another embodiment this feature is provided in a simpler continuous thread cap.

16 Claims, 6 Drawing Sheets

ANTI BACK OFF SCREW ON CLOSURE

This application is a continuation of application Ser. No. 09/314,372, filed May 19, 1999, now abandoned.

BACKGROUND OF THE INVENTION

The invention relates to cap and bottle packaging and, in particular, to screw on caps for bottles with externally threaded neck finishes.

PRIOR ART

Screw on bottle caps have a tendency to loosen from a tightened condition on a threaded bottle neck finish. This tendency has a number of causes which include temperature change, creep in the bottle and cap materials, relaxation of a liner or sealant material, and vibration during handling and shipping. This problem is more frequently encountered when the screw threads have a high pitch to enable the cap to be quickly removed and reinstalled with limited twisting action. Loose caps create problems for the manufacturer and retailer of packaged goods and even for the ultimate user. Loose caps can falsely indicate tampering and, of course, allow spillage or leakage of the contents as well as entrance of moisture into the container. A good moisture seal is especially important, for example, when pharmaceuticals and dietary supplements can be adversely affected by excess moisture content. While "anti back off" features are known in the industry, these features have not generally been available with caps that have child resistant features.

Certain child resistant screw on caps have sections that flex on hinges for movement between locked and unlocked conditions. It has been difficult to provide a hinge with desirable spring back and creep resistant properties while avoiding thick wall sections.

SUMMARY OF THE INVENTION

The invention provides a screw on cap and bottle construction that resists back off or loosening of the cap from a tightened, closed position. The cap includes a hinged portion that carries stop surface areas engageable with complementary stop surface areas on the bottle. The cap hinged portions have spring back characteristics that assure reliable operation of the anti back off surface areas.

In one disclosed embodiment, the bottle, ideally a blow molded product, has a stop surface area that provide a child resistant function and other surface areas for achieving the anti back off function. In the cap, the child resistant and anti back off features are produced on finger manipulatable hinged levers that include separate surface areas for these features.

The disclosed hinge construction achieves highly reliable spring characteristics that assure both child resistant and anti back off properties. The spring characteristics of the hinge allow relatively small closely spaced surface formations to be used on the bottle to obtain high angular resolution in the anti back off function. The spring hinge performance allows proper results to be achieved despite the difficulty in obtaining precise closely spaced surface formations in blow molded bottles. The anti back off stop surface elements have unique complementary configurations that are particularly suited for blow molded bottles and that enhance their performance. As disclosed, where desired the hinge construction can be used to obtain an anti back off function in threaded caps without child resistant properties.

DESCRIPTION OF THE PREFERRED EMBODIMENTS

Figure 1:
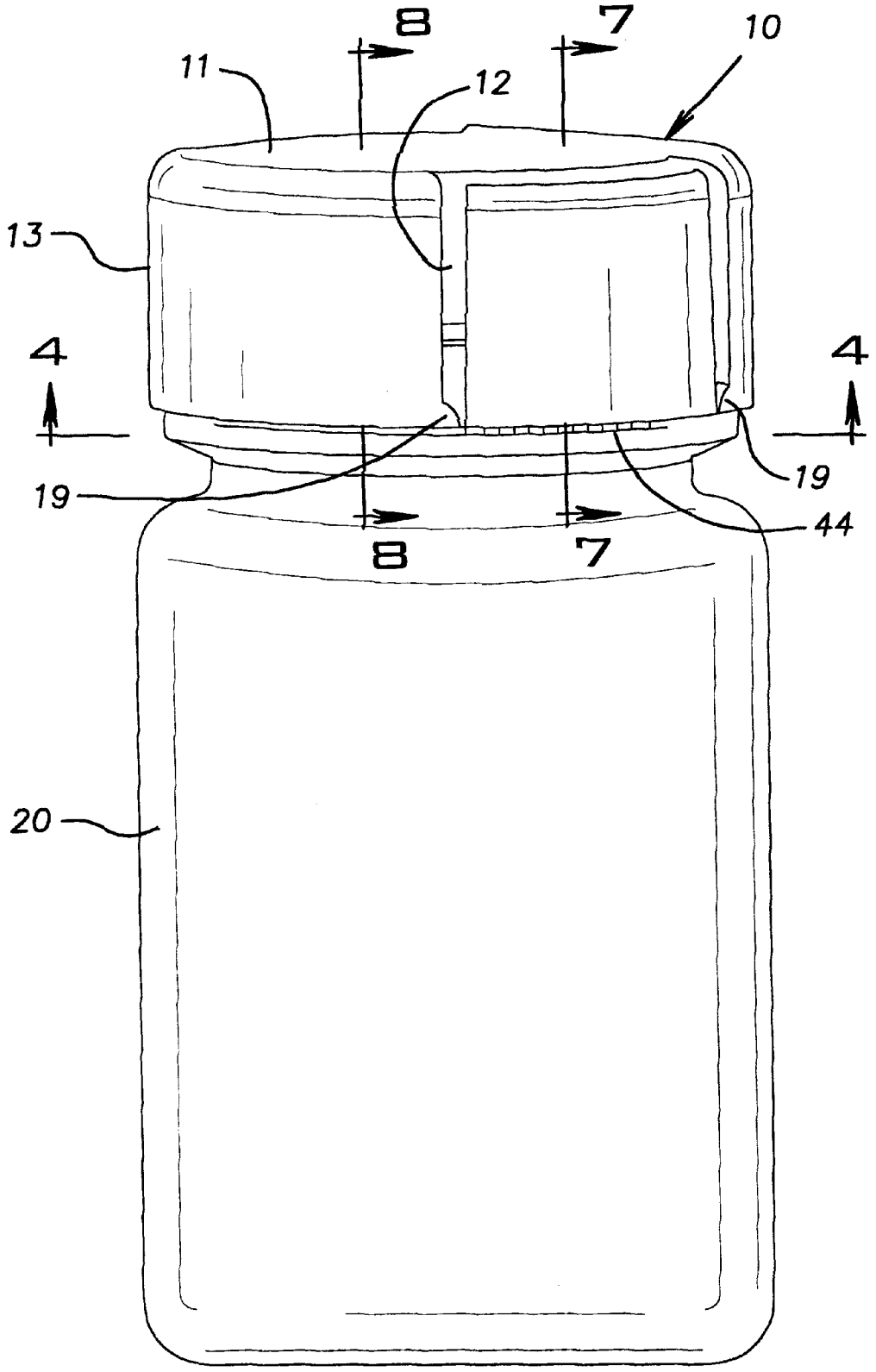
FIG. 1 is an elevational view of a bottle and cap assembly embodying the invention.
Figure 2:
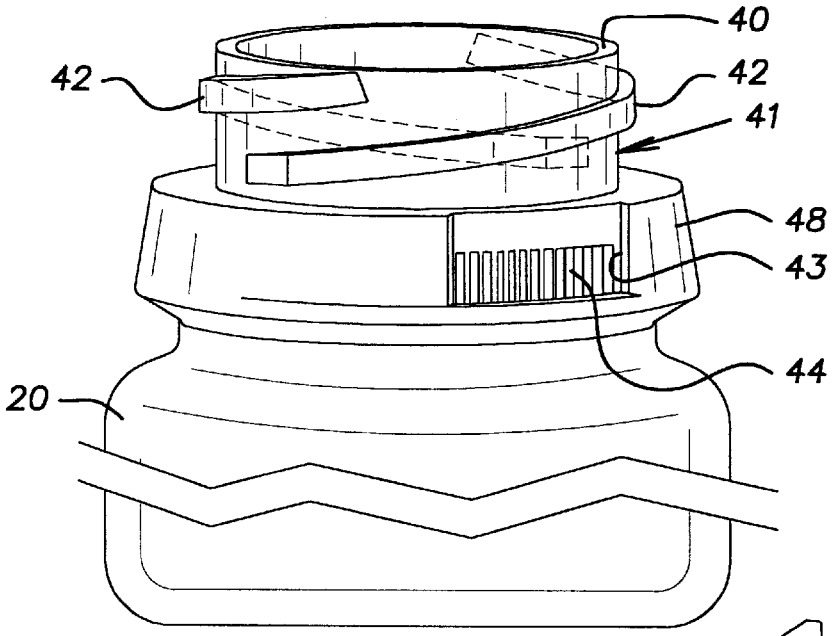
FIG. 2 is a fragmentary perspective view of the bottle of FIG. 1.

Referring now to FIGS. 1 through 8, there is shown a screw on cap and bottle combination embodying the invention. The cap 10 is of a type disclosed in U.S. patent application Ser. No. 08/835,826, filed Apr. 16, 1997. The cap 10 is an injection molded one piece unit of suitable thermoplastic material such as polypropylene. The cap 10 includes an end wall 11 and inner and outer generally concentric cylindrical skirts 12, 13 depending from the end wall 11. The inner skirt 12 has a pair of double helix threads 14 projecting radially inward from an interior generally cylindrical surface 16. The outer skirt 13 is somewhat longer in the axial direction than the inner skirt 12. The outer skirt 13 is circumferentially discontinuous with small axially extending gaps 17 on opposite sides of finger operated levers 18. The levers 18, which are identical, are disposed at diametrally opposite sides of the outer skirt 13 and as discussed more fully below, permit the cap to be unscrewed for opening the bottle, designated 20, when both are simultaneously squeezed inwardly at their tops. Other parts 21 of the outer skirt are fixed to the end wall and to the inner skirt. The gaps 17 are substantially closed at their lower ends by small formations 19 that project circumferentially towards the adjacent edge area of the outer skirt. The formations 19 serve to prevent nesting of identical caps when they are handled in bulk. Alternatively, the formations or projections 19 can be on the main parts of the outer skirt and can extend towards the levers 18.

Each lever 18 is integrally joined to the inner skirt 12 by a hinge 26. The lever 18 has an upper portion 27 and a lower portion or tab 28 above and below its hinge 26, respectively. The levers 18 have an arcuate cylindrical cross section in planes transverse to the axis of the cap and are concave with reference to the interior of the cap.

Figure 7:
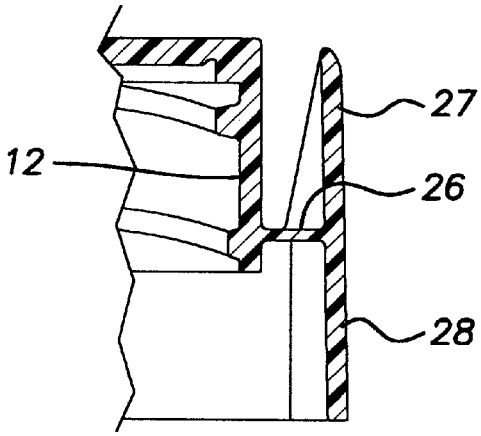
FIG. 7 is a fragmentary cross sectional view of the cap taken in the plane 7—7 indicated in FIG. 1.
Figure 8:
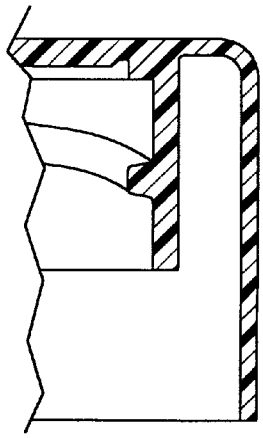
FIG. 8 is a fragmentary cross sectional view of the cap taken in the plane 8—8 indicated in FIG. 1.
Figure 9:
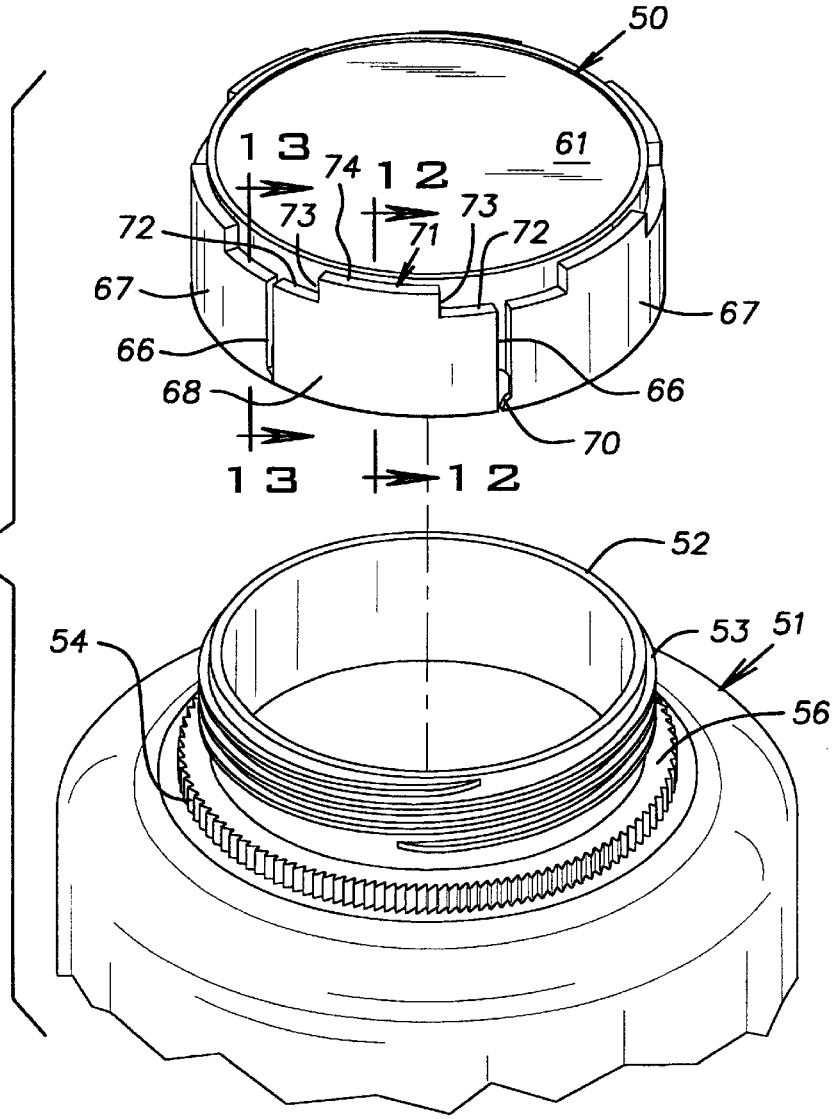
FIG. 9 is an exploded perspective view of a cap and bottle in accordance with a second embodiment of the invention.
Figure 10:
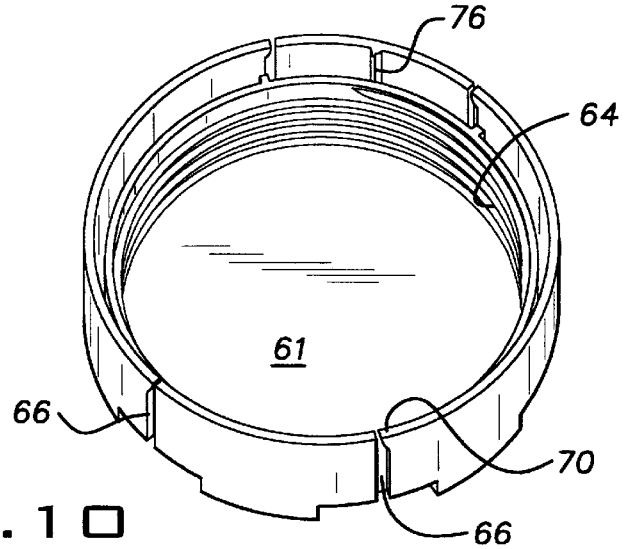
FIG. 10 is a perspective view of the underside of the cap of FIG. 9.

As shown in FIG. 7, for example, the hinge 26 extends radially between the inner skirt 12 and the mid-section of the lever 18. The hinge 26 has a limited wall thickness measured in the axial direction of the cap 10 preferably not greater than the nominal wall thickness of the cap. By way of example, the cap when constructed with a nominal thread size of 33 mm can have a nominal wall thickness of 0.050 in.

Figure 3A:
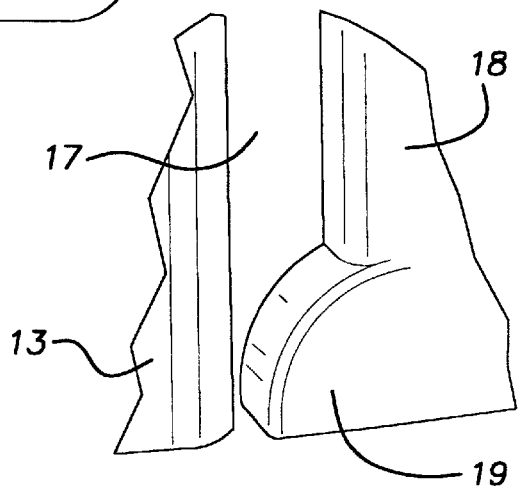
FIG. 3A is a fragmentary enlarged perspective view of a part of the cap of FIG. 1.
Figure 3:
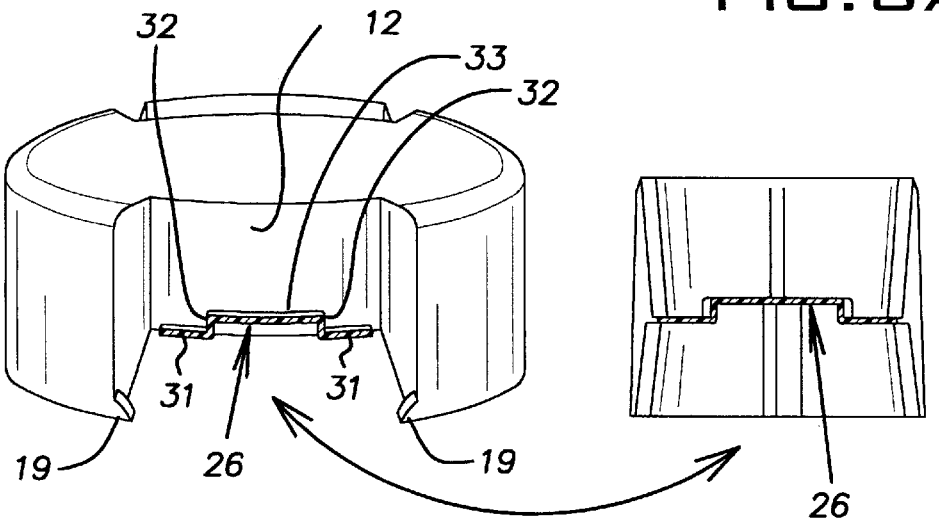
FIG. 3 is an exploded perspective view of the cap of FIG. 1.
Figure 4:
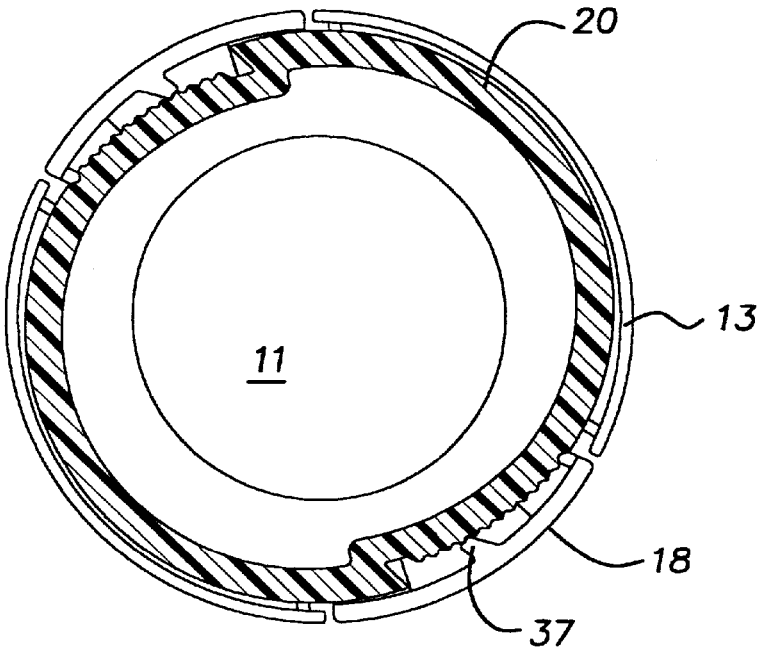
FIG. 4 is a cross sectional view, taken in the plane 4—4 indicated in FIG. 1 through the neck finish of the bottle.

As shown in FIG. 3, the hinge 26 is configured such that it occupies planes transverse to the axis of the cap 10 that are spaced an axial distance greater than the thickness of the hinge measured in the axial direction. In the illustrated embodiment, this configuration is step-like in form having a lower level area 31, a riser area 32 and an upper level area 33. The lower level area and riser area are duplicated on opposite sides of each lever 18. It is contemplated that other non-planar hinge configurations can be used to practice the invention and achieve the desired results. For example, the hinge can have a configuration when viewed in a plane like FIG. 3 in which the upper and lower areas are reversed so that there are two upper areas and one central lower area. Still further, a non-planar configuration of the hinge and the hinge axis can be achieved by substituting a V-shape for the step shape of FIG. 3 or a arcuate shape for the step shape. Such shapes can be concave upwardly or downwardly as viewed in a plane like that of FIG. 3. In all these examples, the pivot axis of the hinge deviates from a single plane or, more specifically, from a zone bounded by two planes spaced apart by the minimum thickness of the hinge.

The lower lever portion 28 on an inner face 36 has a stop member 37 with a major stop surface 38 that projects radially inwardly and slightly angularly rearwardly from the sense that the cap is installed and tightened forwardly, conventionally in a clockwise direction.

The bottle 20 is particularly useful for packaging medicines, nutritional supplements, and the like and is preferably made as a blow molded product of suitable thermoplastic such as polyethylene. The bottle 20 has a circular neck finish 41 that includes a circular mouth 40 and external threads 42. The threads 42 are a double helix with a high helix angle to which the threads 14 of the cap 10 are complimentary. Below the threads 42 on opposite sides the bottle 20 includes major and minor stop surface formations 43, 44.

Figure 5:
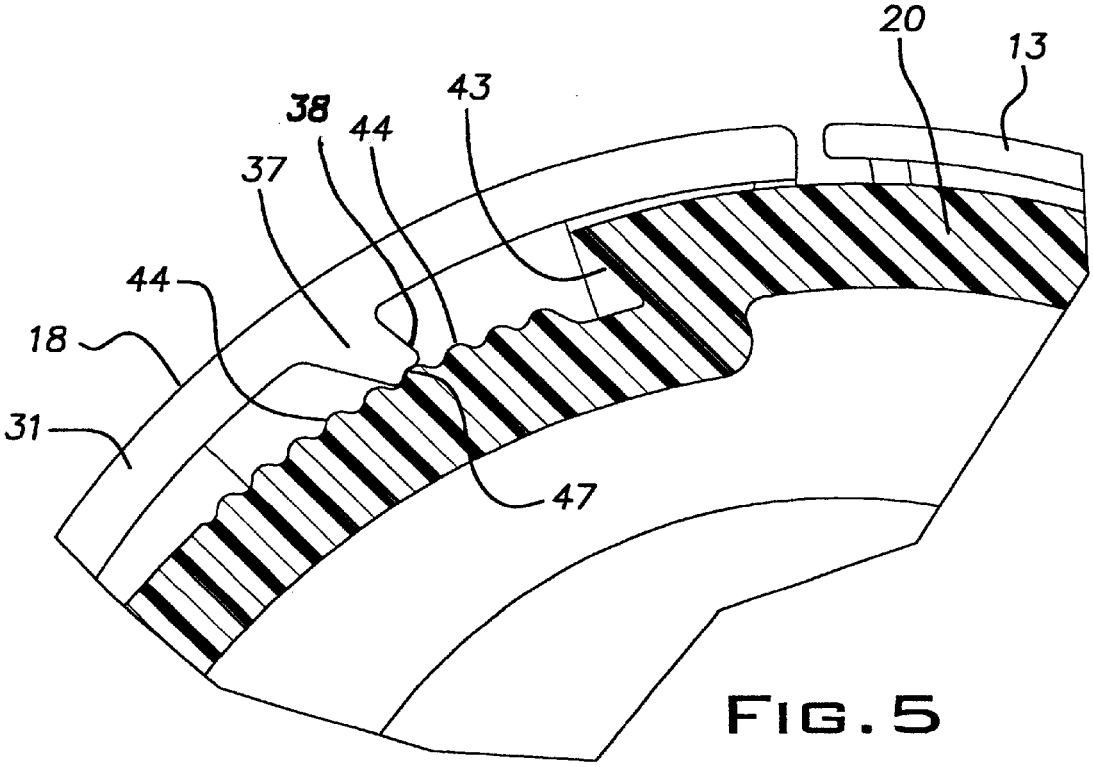
FIG. 5 is a fragmentary view like FIG. 4 on an enlarged scale.
Figure 6:
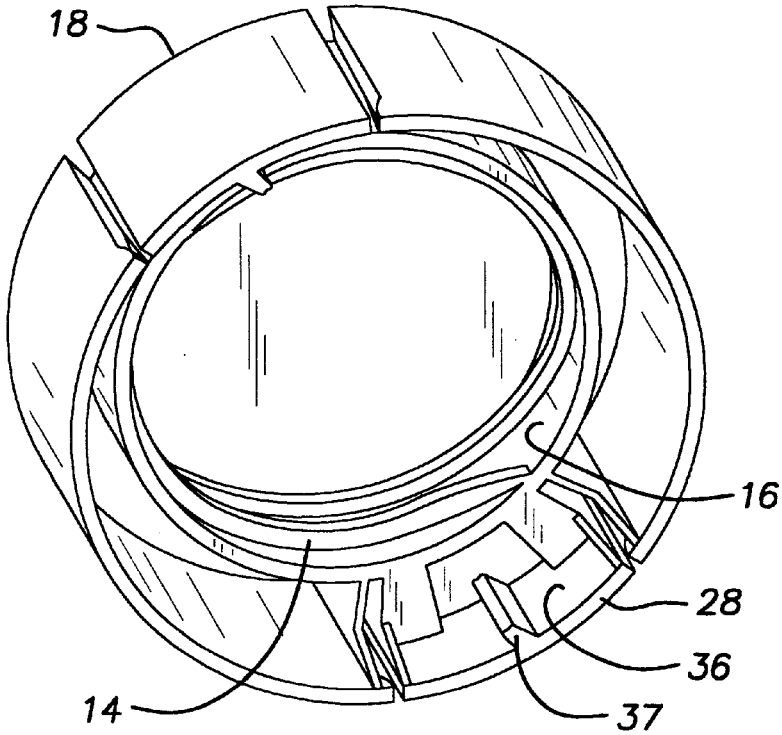
FIG. 6 is a perspective view of the bottom of the cap of FIG. 1.

At each side of the bottle 20 a major one of the stop surface formations 43 extends along the wall with a generally flat configuration preferably oriented slightly from a true radial plane to provide a slight undercut. As seen in FIG. 5, this major stop surface or formation 43 is sufficiently large that it is clearly reflected in the geometry of the underlying inside surface of the bottle. The major stop surfaces 43 make the cap child resistant because the cap cannot be readily unscrewed without squeezing the upper lever portions 27 towards one another typically with two fingers while simultaneously turning the cap. This technique is difficult for children to learn and to perform. When the upper lever sections 27 are squeezed, the lower sections 28 move generally radially outwardly so that their stop members 37 are out of interfering relation with the bottle stop surfaces 43 when the cap 10 is turned on the bottle 20.

The minor stop surfaces or detents 44 are each comprised of a convex curvilinear form when viewed in a plane transverse to the axis of the cap 20. This curvilinear profile extends along the bottle wall in the axial direction. The stop surfaces 44 are relatively small in proportion to the wall thickness of the bottle and do not result in a significant irregular underlying surface on the interior of the bottle. A study of FIG. 5 illustrates how a stop surface 47 on the cap stop member 37 interacts with the minor stop surfaces 44 on the bottle. The cap 10 is proportioned so that when it is assembled in a closed position on the bottle 20, the cap stop surfaces 47 engage the minor stop surfaces 44 on the bottle 20. The hinge 26 of each lever 18 is effective to resiliently maintain this surface-to-surface contact with a desired force level. When approaching the closed position, each lower lever portion or tabs 28 is carried radially outward as the stop member 37 rides onto a conical shoulder portion 48 of the bottle until the stop member or finger 37 passes the major stop surface 43 and the lower lever portion 28 closes radially inwardly.

Dimensional variations in the cap 10 and bottle 20, as well as characteristics of any liner used in the cap, make it difficult to control the final angular position at which the cap is properly tightened. Variations in the angular position of the cap relative to the bottle for proper tightness is accommodated by the series of circumferentially distributed minor bottle stop surfaces 44. The minor stop surfaces 44 extend over a relatively large arcuate zone on each side of the bottle 20 so that in any expected variation in the fully tightened position of the cap the cap stop surface 47 will always be in registry with an area of these stop surfaces 44.

The bottle stop surfaces or teeth 44, in the preferred embodiment, are characterized by a curvilinear or wavelike form. The circumferential spacing between successive peaks or valleys of the minor stop surfaces 44 is relatively small to enable the cap stop surface 47 to engage a minor stop surface at or sufficiently close to a final tightened angular position to maintain a seal between the cap 10 and bottle 20. In the illustrated case, the cap stop surface 47 engages the majority of a peak of a minor stop surface 44, engaging areas on both sides of the peak, and at least a portion of an adjacent valley.

The curvilinear configuration of the disclosed stop or detent formations 44 on the bottle is advantageous for blow molded bottles since it enables these formations to be accurately molded even while being spaced closely together. FIG. 5 shows that the cap stop surface 47 is concave and complimentary to a minor stop surface 44, thereby enabling it to securely grip onto the last minor stop surface that it passes when the cap is tightened on the bottle. The mutually engaged cap and bottle surfaces 47 and 44 provide an anti back off function by preventing the cap from any significant unintended loosening or backing off from a closed sealing position. The resistance to opening developed by these anti back off stop surfaces 44, 47 is a function of the force between the surfaces that is maintained by the hinge 26 of the respective levers 18. The disclosed multi plane hinge has demonstrated a superior resilience and resistance to creep. The hinge performance is important both for the cap's child resistant feature and the anti back off feature. The multi plane hinge 26 disclosed herein snaps back essentially fully to its child resistant position and its anti back up position after a lever is pivoted either during initial installation of the cap on the bottle or after the levers have been operated to release the cap and are thereafter pivoted to enable the cap to be reinstalled.

The location of the stop surfaces 44 on a wall of the bottle that is generally cylindrical and concentric with the axis of the neck finish has advantages in the provision of a reliable product. When the portion of the bottle forming the stop surfaces or detents 44 is blow molded, these surfaces tend to be more accurately formed when the wall of the bottle need only be expanded radially into the mold. Moreover, with the resulting axial orientation of the curvilinear forms of the stop surfaces 44 there is no variation in the detenting or anti back off function owing to a different angular and therefore different vertical position of the cap depending on where it ends up in a tightened position. The anti back off function of the detent or stop surfaces 44, 47 is particularly useful where, as shown, the thread pitch of the cap and bottle is high and friction locking forces in the threads are somewhat reduced.

FIGS. 9 through 13 illustrate another embodiment of the invention where a screw on cap 50 and bottle 51 are provided with an anti back off feature. The bottle 51 is preferably a blow molded part having a neck finish with a circular mouth 52 and external threads 53. Below the threads 53, the bottle 51 is formed with external detent teeth or stop surfaces 54 which in the illustrated embodiment are situated around the full circumference of the bottle. The detent teeth 54 are relatively small and closely spaced relative to one another. In the illustrated bottle 51, the distance between the apex of adjacent teeth is not substantially greater than twice the wall thickness of the bottle in this area and the radial height of the teeth is less than the minimum wall thickness in this area, this thickness being about 0.040 in. where the bottle is sized to accept a nominal 63 mm cap. The teeth 54 have a generally curvilinear profile when viewed in a plane transverse to the axis of the bottle mouth 52 and such profile projects axially with reference to this axis. The teeth or detents 54 are relatively small in comparison to the wall thickness of the bottle and are not substantially reflected in the underlying interior surface of the bottle.

An intermediate external area 56 between the threads 53 and the teeth 54 is conical and flares radially outwardly in the axial direction from the threads and the teeth. The bottle is preferably formed of a suitable thermoplastic material such as polyethylene.

The cap 50 is preferably an injection molded one piece part of suitable thermoplastic material such as polyethylene. The cap includes an end wall 61 and concentric inner and outer skirts 62, 63, respectively. The inner skirt 62 depends from the end wall 61 and includes internal threads 64 complimentary to the threads 53 on the bottle 50. The outer skirt 63 is cylindrical but circumferentially segmented by axial extending slots 66 that separate identical diametrically opposite major skirt portions 67 from somewhat smaller hinged skirt portions 68 also diametrally opposed from one another. The major portions 67 are fixed to the inner skirt 62 by radially extending webs along their top edges and the majority of their vertical edges. The outer skirt 63 extends axially below a lower edge 69 of the inner skirt 62. The slots 66 at their lower ends are effectively closed by small projections 70 formed at the lower ends of the major skirt portions 67 to prevent nesting.

The hinged portions or tabs 68 are supported on the inner skirt 62 by integral hinges 71. The hinges 71 like the hinges 26 of the embodiment of FIGS. 1 through 8 exist in multiple planes transverse to the axis of the cap so that the pivot axis of the hinge 71 diverts from a flat plane perpendicular to the cap axis. The hinge 71 is axially stepped so that it has a pair of circumferentially spaced lower sections 72, riser sections 73 and a central upper section 74.

Figure 11:
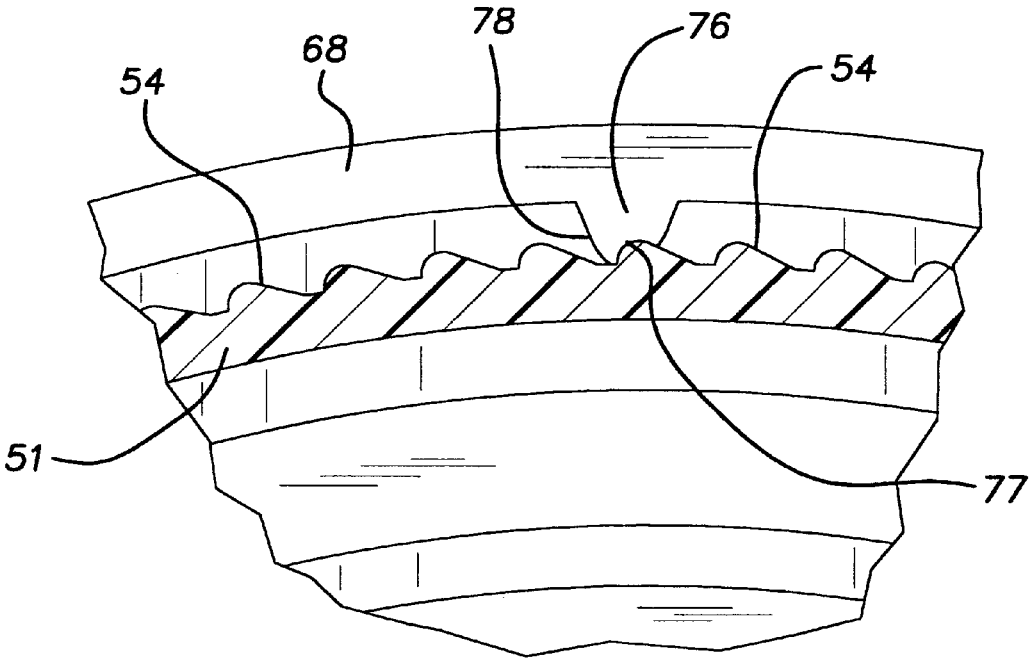
FIG. 11 is a fragmentary cross sectional view of the cap and bottle of FIG. 9 in assembled relation, taken in a plane transverse to the axis of the cap and bottle neck, and showing details of an anti back off feature.
Figure 12:
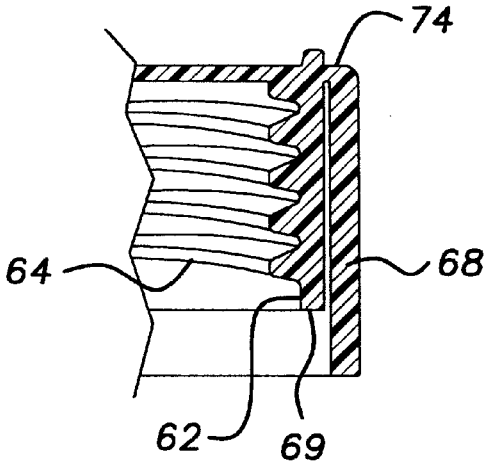
FIG. 12 is a fragmentary cross sectional view of the cap taken in the plane indicated at 12—12 in FIG. 9.
Figure 13:
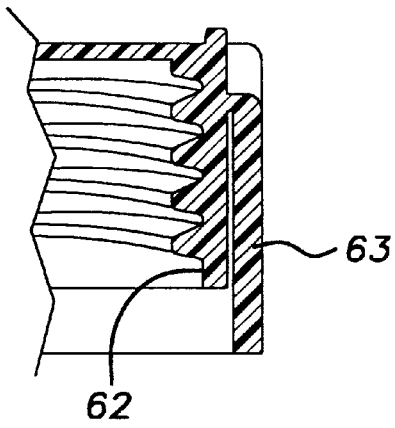
FIG. 13 is a fragmentary cross sectional view of the cap taken in the plane indicated at 13—13 in FIG. 9.

A locking post or formation 76 projects radially inwardly from an inside surface of each outer skirt hinged portion 68. The post 76 has a stop surface detent area 77 that is complimentary in shape to the profile of the projecting bottle teeth 54. As shown in FIG. 11, the cap stop surface 77 is concave so that it can receive a tooth 54 in the manner of a socket or detent and engage portions on both sides of the apex of the tooth. A leading surface 78 of the locking post 76, in the sense of motion relative to the teeth 54 when the cap is screwed clockwise onto the bottle, has a convex configuration to enable it to be cammed radially outwardly over successive teeth 54. The cap locking posts 76 and bottle teeth 54 work in a manner like that of the stop surfaces 47 and 44 of the embodiment of FIGS. 1 through 8. When the cap 50 is being assembled on the bottle, the locking posts 76 engage the conical surface 56 and are cammed radially outwardly until they overlie the area of the bottle teeth 54. The hinges 71 enable the skirt portions or tabs 68 to resiliently accommodate this radial motion including that required for passage of the locking posts circumferentially across successive teeth 54 until the cap 50 has been tightened to a desired torque level and the bottle mouth 52 is sealed by the cap with any desired liner in the cap.

The cap 50 is proportioned and the hinges 71 act to resist movement of the locking posts 76 radially outwardly when, after tightening, the cap 50 tends to come loose by creep, relaxation of material, temperature and pressure changes, vibration, and the like. On each side of the cap 50, the locking posts 76 will engage the last tooth 54 that each passes when the desired level of tightening is reached. The actual engagement can be where the tightened condition corresponds exactly with the angular registration between each locking post stop surface 77 and the teeth or later when internal forces tend to cause the cap to untighten or back off slightly. The close positioning of adjacent teeth 54 assures that any loosening movement would be less than that required to unseal the cap from the bottle. Engagement of the locking posts 76 with the teeth 54 prevent further backing off of the cap under normal internal influences.

The hinges 71 will allow the locking posts 76 to release their grip on the teeth 54 when a deliberate manual effort is applied to untwist the cap. The rounded surfaces of the teeth 54 cam the locking posts 76 radially outwardly in this instance so that at some torque level in the opening direction (typically counter clockwise), the constraint of the locking posts developed by the hinges 71 will be overcome. This release torque level can be selected by final design of the hinges, for example.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A child resistant and leak resistant cap comprising an injection molded one-piece thermoplastic body for use on a bottle with an externally threaded neck finish, the cap being generally circular and having a major stop surface normally preventing the cap from being unscrewed from the bottle, squeezable portions on diametrally opposite sides that function to release the cap from the bottle for unscrewing when squeezed, an anti back off stop surface separate from the major stop surface and engageable with formations on the bottle below the threads on the neck, the anti back off surface being constructed and arranged to operate with relatively closely spaced formations on the bottle whereby the anti back off surface formations can limit the degree to which the cap unintentionally can unscrew to that in which the cap remains sealed on the bottle.

2. A cap as set forth in claim 1, wherein the stop surfaces are arranged to work with formations on a bottle that have differential heights, the higher formations cooperating to provide the child resistant feature.

3. A cap as set forth in claim 1, wherein the anti back off surface has a configuration complimentary to curvilinear formations on a bottle.

4. A cap as set forth in claim 1, wherein said cap has an end wall and a skirt portion axially below said end wall, said anti back off surface projecting radially inwardly from said skirt portion and when the cap is squeezed for opening, being arranged to move radially outwardly.

5. A cap as set forth in claim 4, wherein said skirt portion carrying said anti back off surface is supported by an integral hinge having an axis that deviates from a single plane.

6. If A leak resistant cap comprising a thermoplastic injection molded body, the cap body including an end wall and an internally threaded skirt depending from the end wall and concentric with the axis of the cap, a depending tab radially outward of the threaded skirt, the tab being supported relative to the threaded skirt by an integral hinge, the hinge having a configuration with a hinge axis that deviates axially from a flat plane, and a stop element projecting radially inwardly from the tab, the stop element being arranged to resiliently engage one of a plurality of closely spaced projecting surfaces on the neck finish of a bottle to resist unintentional back off of the cap from a sealed position on the bottle.

7. A cap as set forth in claim 6, wherein said tab is provided in duplicate on opposite sides of the cap.

8. A cap as set forth in claim 7, wherein said tabs have arcuate cross sections when viewed in planes transverse to the axis of the cap.

9. A cap as set forth in claim 6, including outer skirt portions that cooperate with the tabs to form an outer circumferentially segmented skirt.

10. A cap as set forth in claim 9, wherein the tabs have generally axially extending edges and the outer skirt portions are spaced circumferentially from said tab edges by respective gaps, the lower areas of said gaps being substantially closed by local projections of the skirt elements to prevent nesting of parts of like caps into said gaps.

11. In combination, a bottle and a cap for sealing the bottle, the bottle being a blow molded thermoplastic product having an externally threaded neck below its mouth and a plurality of relatively small curvilinear detent surfaces on its exterior surface below the threads, the spacing between the detents being limited to about less than two times the wall thickness of the bottle in the area of the detents, the cap being an injection molded thermoplastic part, the cap having an end wall for sealing the mouth of the bottle optionally with a liner, a cylindrical skirt with internal threads complimentary to the threads of the bottle, a depending tab radially outward of the skirt, the tab having a radially inwardly projecting surface arranged to mate with the detent surfaces of the bottle, the tab being arranged to normally hold the projecting surface in contact with an area of the detent surfaces and being capable of resiliently deflecting radially outwardly to release the detent surfaces for removal of the cap.

12. A cap as set forth in claim 11, wherein said tab is duplicated on diametrally opposite sides of the cap.

13. A cap as set forth in claim 11, wherein said detent surfaces engaged by the projecting surface are curvilinear convex surfaces.

14. A cap as set forth in claim 13, wherein said projecting surfaces are complimentary and formed to engage said curvilinear convex detent surfaces.

15. A cap as set forth in claim 11, wherein said tab is supported by an integral hinge.

16. A cap as set forth in claim 15, wherein said hinge has a configuration that includes a hinge axis that departs from a plane transverse to the axis of the cap.

* * * * *

UNITED STATES PATENT AND TRADEMARK OFFICE

CERTIFICATE OF CORRECTION

PATENT NO. : 6,296,130 B1
DATED : October 2, 2001
INVENTOR(S) : Michael J. Forsyth et al.

It is certified that error appears in the above-identified patent and that said Letters Patent is hereby corrected as shown below:

Title page,
Item [75], Inventors should read as follows:

-- [75] Inventors: Michael J. Forsyth, Stow; Charles A. Webster, Bowling Green, both of OH (US); Douglas S. Martin, New Castle, PA (US); James P. Black, Twinsburg, OH (US); Bradford E. Seaman, Birdsboro, PA (US) --

Signed and Sealed this

Thirtieth Day of July, 2002

*Attest:*

*Attesting Officer*

JAMES E. ROGAN
*Director of the United States Patent and Trademark Office*